US005566426A

United States Patent [19]

Lu

[11] Patent Number: 5,566,426

[45] Date of Patent: Oct. 22, 1996

[54] CAM-ACTION CUFF LINK

[76] Inventor: Cheng-Fa Lu, 5F, No. 147, Sec. 2, Chung Hwa Rd., Taipei, Taiwan

[21] Appl. No.: 439,888

[22] Filed: May 12, 1995

[51] Int. Cl.[6] ..... A44B 1/34

[52] U.S. Cl. ..... 24/102 PL; 24/102 FC; 24/102 R; 24/114.2; 24/114.3

[58] Field of Search ..... 24/102 FC, 102 R, 24/114.2, 114.3, 102 PL

[56] References Cited

U.S. PATENT DOCUMENTS

| | | | |
|---|---|---|---|
| 885,879 | 4/1908 | Smith | 5/498 X |
| 1,434,491 | 11/1922 | Hubbell | 24/114.2 X |
| 1,718,844 | 6/1929 | White et al. | 24/114.2 X |
| 1,752,732 | 4/1930 | Chuprin | 24/102 FC |
| 2,197,882 | 4/1940 | Simpson | 24/102 R |
| 3,535,747 | 10/1970 | Benn | 24/102 R |
| 5,040,271 | 8/1991 | Goyette | 24/102 R |
| 5,414,909 | 5/1995 | Kielty | 24/102 R X |

*Primary Examiner*—Peter M. Cuomo
*Assistant Examiner*—Stephen Vu
*Attorney, Agent, or Firm*—Browdy and Neimark

[57] ABSTRACT

A cuff link including a base, which has two parallel blocks at the top and a longitudinal top open chamber defined between the blocks, which blocks each having a pivot hole and a side opening communicated between the respective pivot hole and the top open chamber, a button, which has a shank, which has two pivot pins respectively inserted through the side openings on the blocks into the pivot holes thereof for permitting the button to be turned relative to the base between the fastening position and the unfastening position, and a spring plate inserted into the top open chamber to support the shank and to prevent the pivot pins from moving out of the pivot holes.

2 Claims, 6 Drawing Sheets

CAM-ACTION CUFF LINK

BACKGROUND OF THE INVENTION

The present invention relates to cuff links, and relates more particularly to an inexpensive cuff link which is easy to assemble and practical in use.

A variety of cuff links have been disclosed for fastening shirt cuffs, and have appeared on the market. These cuff links are commonly comprised of a base and a button linked to the base and turned between a horizontal position (the fastening position) and a vertical position (the unfastening position). FIG. 1 shows a cuff link according to the prior art, in which the base of the cuff link is shaped like a hollow cylinder turned about a rectangular transverse rod between two upright rods on the button (not shown), and spring means is mounted inside the cylindrical base proud the rectangular transverse rod to hold the base in the fastening position or the unfastening position. FIG. 2 shows another structure of cuff link to the prior art. This structure of cuff link is similar to that shown in FIG. 1, but the base is made of flat oval shape. FIG. 3 shows still another structure of cuff link according to the prior art, in which the button has a shank with a pivot hole supported on a spring plate between two upright rods on the base; the base has two upright rods, a pivot inserted through the pivot hole on the shank of the button and connected between the two upright rods, and a spring plate suspended between the upright rods to support the shank of the button. FIG. 4 is an extended-out view of still another structure of cuff link according to the prior art in which the base, which is extended out, is made of hollow structure having a longitudinal opening and a spring plate mounted inside the opening, the button has a shank stopped against the spring plate on the base and two pivot pins perpendicularly extended from the shank in reversed directions and covered within the base when the base is shape formed.

The aforesaid cuff links are still not satisfactory in function. One common drawback of the aforesaid cuff links is that they are complicated to assemble. Another common drawback of the aforesaid cuff links is that they are expensive to manufacture. Still another common drawback of the aforesaid cuff links is that electroplating solution tends to be gathered on the inside of the base or the button when covering the the cuff link with a gold or silver coating, causing the base or the button to rust quickly. If a cuff link begins to rust, the shirt cuff will be contaminated.

SUMMARY OF THE INVENTION

It is one object of the present invention to provide a cuff link which is simple in structure. It is another object of the present invention to provide a cuff link which is inexpensive to manufacture. It is still another object of the present invention to provide a cuff link which is easy to assemble. To achieve these objects, there is provided a cuff link comprised of a base, which has two parallel blocks at the top and a longitudinal top open chamber defined between the blocks, which blocks each having a pivot hole and a side opening communicated between the respective pivot hole and the top open chamber, a button, which has a shank, which has two pivot pins respectively inserted through the side openings on the blocks into the pivot holes thereof for permitting the button to be turned relative to the base between the fastening position and the unfastening position, and a spring plate inserted into the top open chamber to support the shank and to prevent the pivot pins from moving out of the pivot holes.

DETAILED DESCRIPTION OF THE PREFERRED EMBODIMENT

Figure 1:
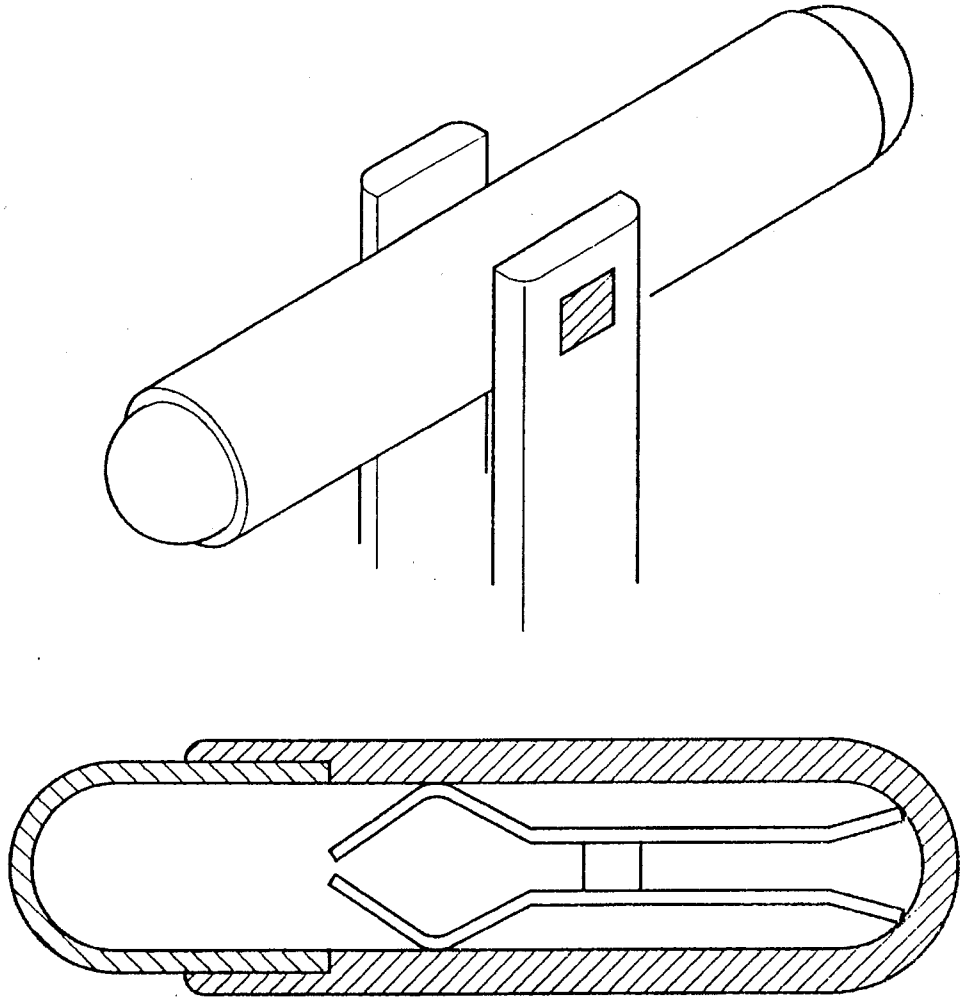
FIG. 1 (PRIOR ART)
FIG 1 shows a cuff link according to the prior art.
Figure 2:
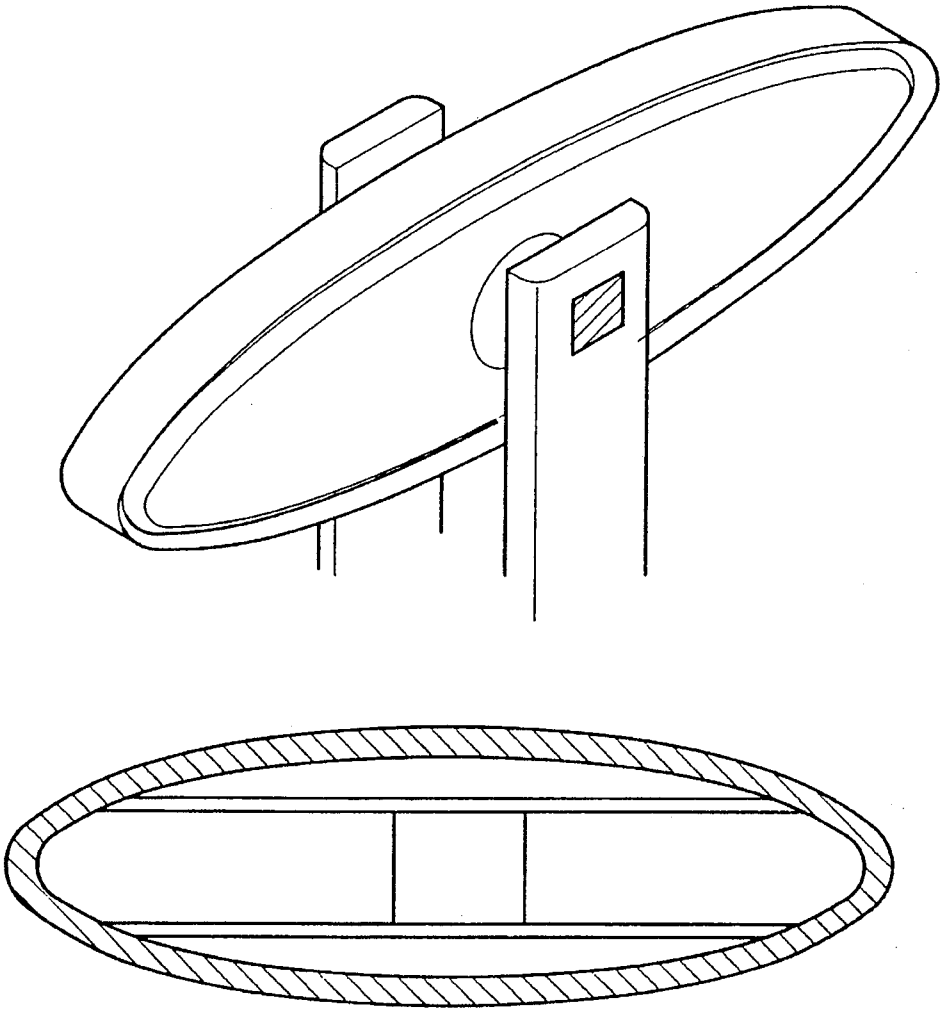
FIG. 2 (PRIOR ART)
FIG. 2 shows another structure of cuff link according to the prior art.
Figure 3:
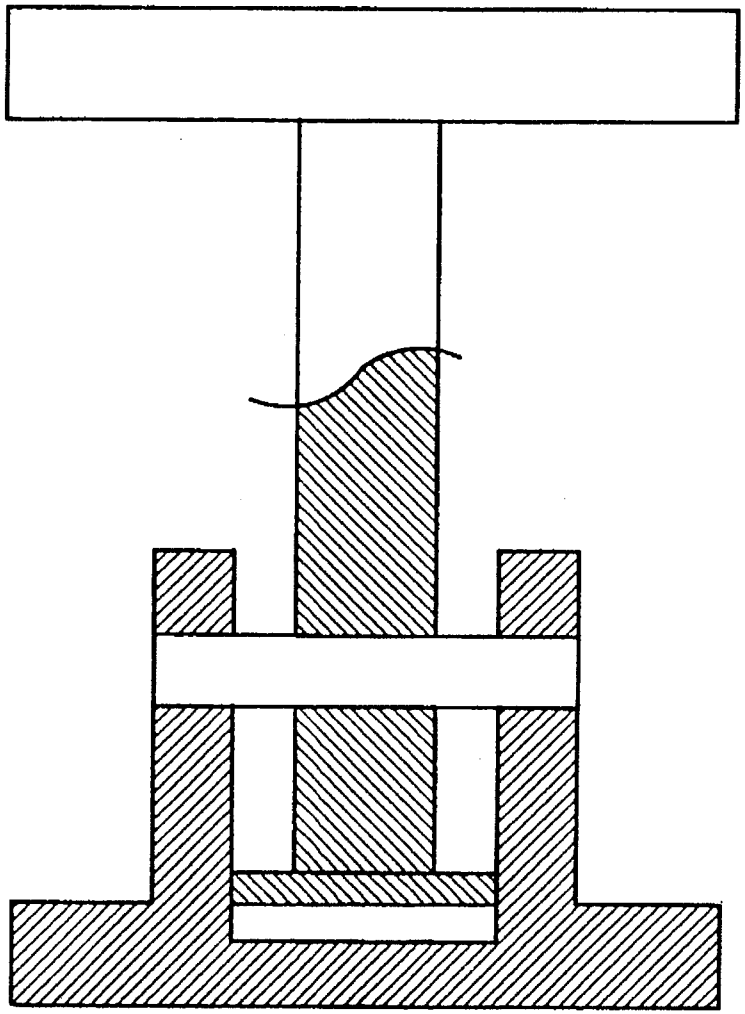
FIG. 3 (PRIOR ART)
FIG. 3 shows still another structure of cuff link according to the prior art.
Figure 4:
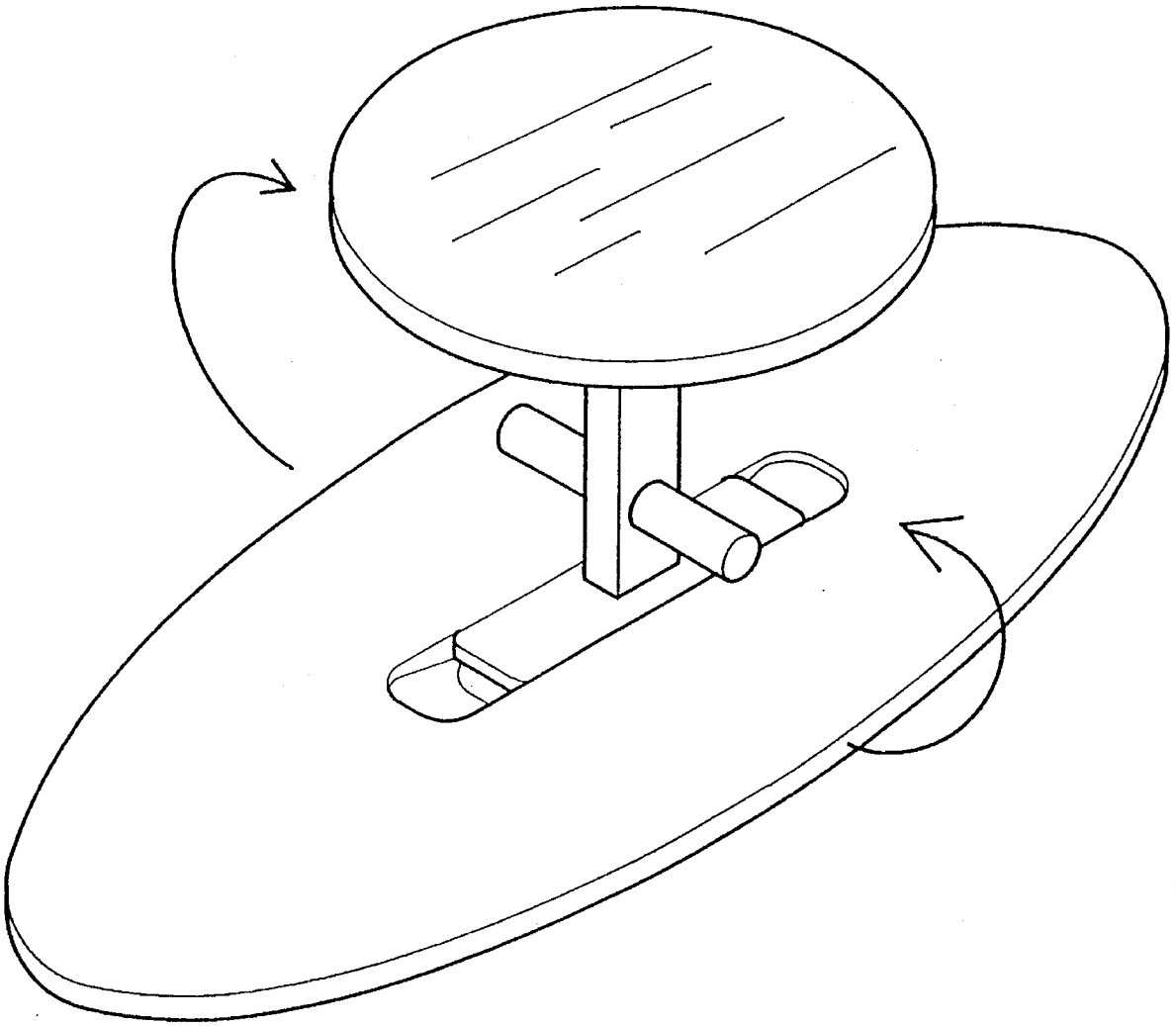
FIG. 4 (PRIOR ART)
FIG. 4 is an extended-out view of still another structure of cuff link according to the prior art.
Figure 5:
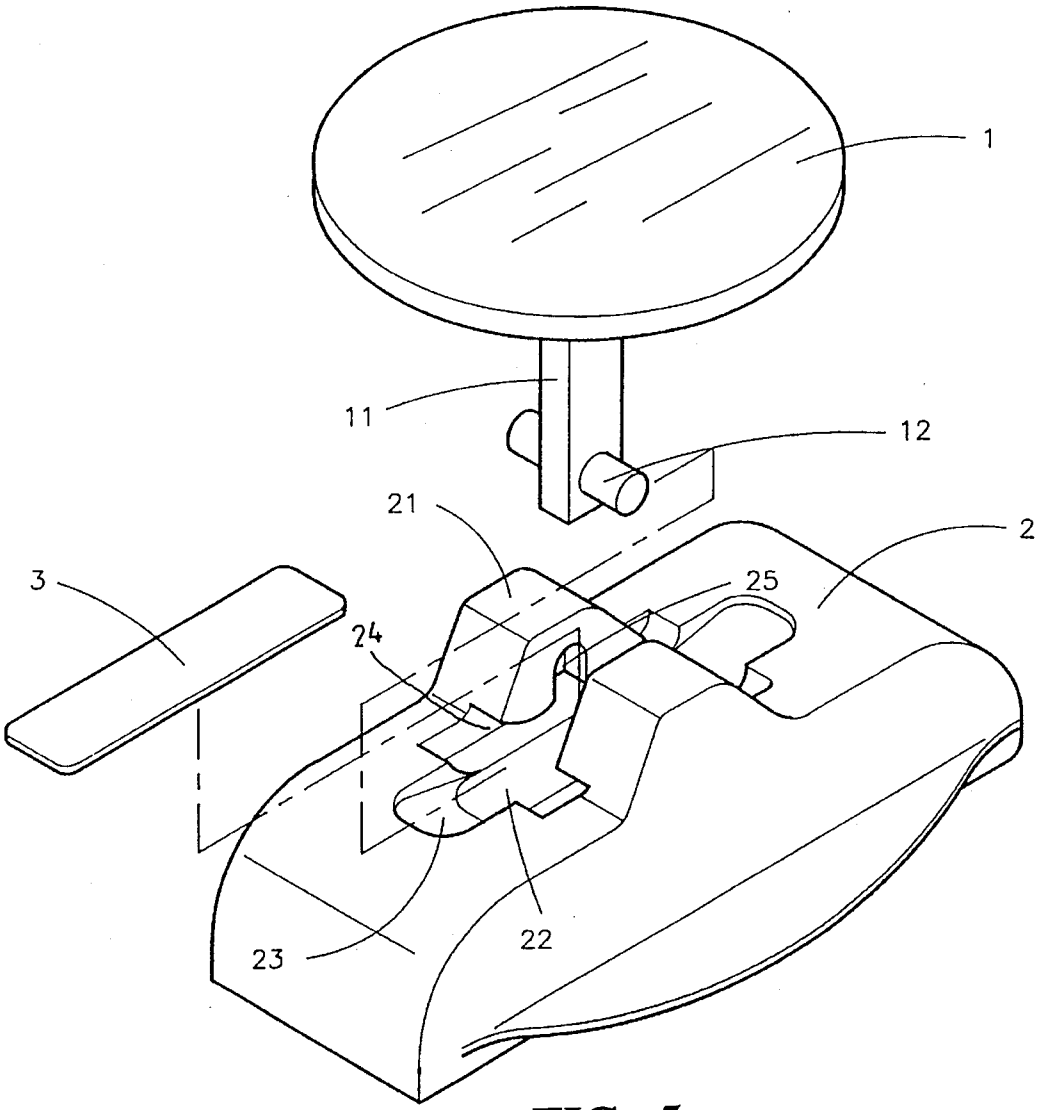
FIG. 5 is an elevational view of a cuff link according to the present invention.

Referring to FIG. 5, a cuff link in accordance with the present invention is comprised of a button 1, a base 2, and a spring plate 3. The button 1 is made of any desired pattern having a shank 11 extended from the center of the bottom side thereof and two pivot pins 12 perpendicularly extended from the shank 11 near the end in reversed directions. The base 2 comprises two parallel blocks 21 raised from the top side thereof, a longitudinal top open chamber 22 defined between the blocks 21, two pivot holes 25 respectively and transversely made on the blocks 21, and two openings 24 respectively made on the blocks 21 and imparting a passage for letting the pivot pins 12 of the button 1 be respectively inserted into the pivot holes 25. The longitudinal top open chamber 22 has one end terminating in an upward guide slope 23.

Figure 6:
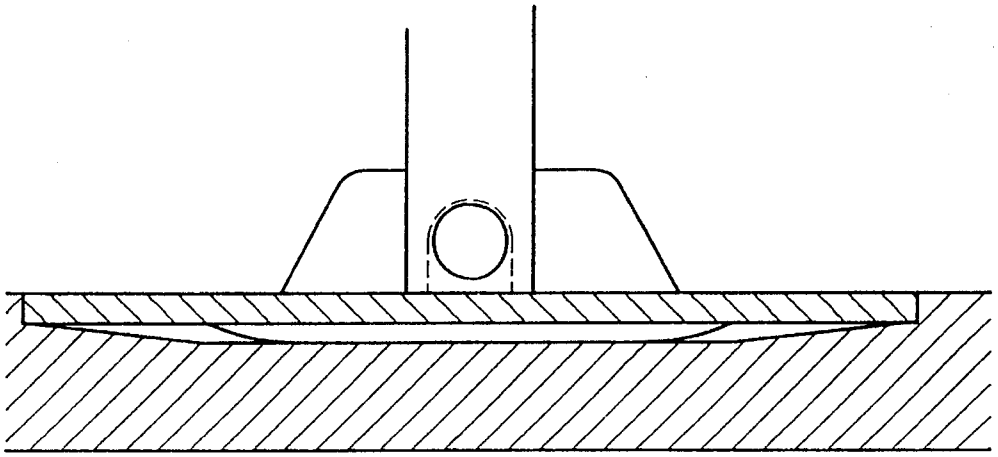
FIG. 6 is a sectional plain view of the cuff link shown in FIG. 5.

Referring to FIG. 6, the pivot pins 12 of the button 1 are respectively inserted through the side openings 24 into the pivot holes 25, then the spring plate 3 is inserted through the upward guide slope 23 into the top open chamber 22 to support the shank 11 and to prevent the pivot pins 12 from moving out of the pivot holes 25. The top open chamber 22 curves inwards. Therefore, when the spring plate 3 is installed, a gap is left around the middle area between the spring plate 3 and the top open chamber for permitting the shank 11 to be turned relative to the base 2.

Figure 7:
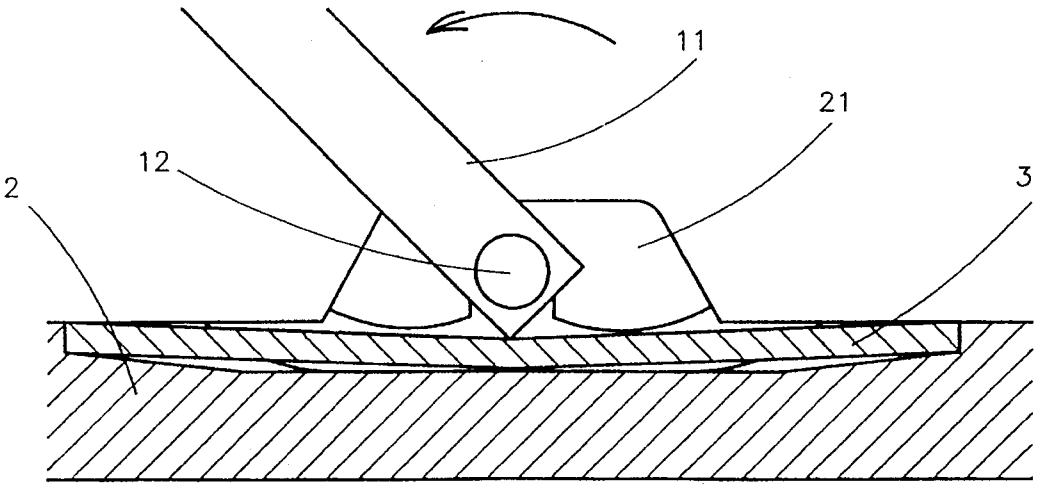
FIG. 7 is similar to FIG. 6 but showing the button turned relative to the base.

Referring to FIG. 7, by turning the pivot pins 12 in the pivot holes 25, the button 1 can be moved between the fastening position perpendicular to the base 1 and the unfastening position in parallel to the base 2.

It is to be understood that the drawings are designed for purposes of illustration only, and are not intended as a definition of the limits and scope of the invention disclosed.

I claim:

1. A cuff link comprising:

a rigid base having a top side, two parallel blocks raised from said top side, and a longitudinal top open chamber defined between said blocks and opening on said top side, said blocks each including a respective pivot hole transversely disposed at an inner side in communication with said top open chamber;

said blocks each including a respective side opening communicating with said top open chamber and communicating between the respective pivot hole and said top side of said base;

a button having a bottom side and a shank perpendicularly extended from the center of said bottom side, said shank having two pivot pins aligned at two opposite sides and respectively inserted through each side opening on said blocks into said pivot holes for permitting said button to be secured to said base and turned between a fastening position perpendicular to said base and an unfastening position in parallel to said base;

said respective side opening comprising means for inserting a respective one of the two pivot pins into the respective pivot hole from said top side of said base; and a spring plate inserted into said top open chamber on said top side of said base, said spring plate comprising means for supporting said shank of said button on said base.

2. The cuff link of claim 1 wherein a gap is maintained between said spring plate and a bottom surface of said top open chamber for permitting said spring plate to be compressed downwards when said button is turned relative to said base.

* * * * *